US009138995B2

(12) United States Patent
Mizutani et al.

(10) Patent No.: US 9,138,995 B2
(45) Date of Patent: Sep. 22, 2015

(54) LIQUID EJECTION HEAD, LIQUID EJECTION METHOD, AND PRINTING APPARATUS EMPLOYING THIS EJECTION HEAD

(71) Applicant: CANON KABUSHIKI KAISHA, Tokyo (JP)

(72) Inventors: Michinari Mizutani, Kawasaki (JP); Yasunori Takei, Tokyo (JP); Yoshihiro Hamada, Yokohama (JP); Masaki Oikawa, Inagi (JP); Toshikazu Nagatsuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/338,978

(22) Filed: Jul. 23, 2014

(65) Prior Publication Data

US 2015/0029268 A1 Jan. 29, 2015

(30) Foreign Application Priority Data

Jul. 29, 2013 (JP) ..... 2013-156740

(51) Int. Cl.
*B41J 2/05* (2006.01)
*B41J 2/14* (2006.01)

(52) U.S. Cl.
CPC ..... *B41J 2/1404* (2013.01); *B41J 2002/14185* (2013.01); *B41J 2202/11* (2013.01)

(58) Field of Classification Search
CPC ..... B41J 2002/14185; B41J 2/14112; B41J 2/1412
See application file for complete search history.

(56) References Cited

U.S. PATENT DOCUMENTS

| | | | | |
|---|---|---|---|---|
| 6,428,144 | B2 * | 8/2002 | Mizutani | 347/47 |
| 6,761,435 | B1 * | 7/2004 | Powers | 347/65 |
| 7,506,962 | B2 | 3/2009 | Murakami et al. | |
| 7,735,962 | B2 | 6/2010 | Matsumoto et al. | |
| 7,771,026 | B2 | 8/2010 | Ide et al. | |
| 7,938,511 | B2 | 5/2011 | Tomizawa et al. | |
| 7,963,635 | B2 | 6/2011 | Oikawa et al. | |
| 8,087,759 | B2 | 1/2012 | Oikawa et al. | |
| 8,376,522 | B2 | 2/2013 | Oikawa et al. | |
| 8,439,483 | B2 | 5/2013 | Kihara et al. | |
| 8,449,078 | B2 | 5/2013 | Nagatsuka | |
| 2013/0328968 | A1 | 12/2013 | Hamada et al. | |

FOREIGN PATENT DOCUMENTS

JP 2002-321369 A 11/2002

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head in which the adverse effect of a heating resistor element due to cavitation is reduced and a printing apparatus employing this liquid ejection head are provided. When a length of a heating resistor element in a direction in which ink is to be supplied is defined by L, the center of an ejection port is shifted, at a distance equal to or longer than L/7 toward a location of an ink supply port, from the center of the heating resistor element, viewed in a direction in which ink is to be ejected. When a length of the ejection portion in the direction in which ink is to be ejected is defined as l and a length of a bubble generation chamber in the direction in which the liquid is to be ejected is defined as h, l/h is equal to or less than 2.

4 Claims, 13 Drawing Sheets

LIQUID EJECTION HEAD, LIQUID EJECTION METHOD, AND PRINTING APPARATUS EMPLOYING THIS EJECTION HEAD

BACKGROUND OF THE INVENTION

1. Field of the Invention

The present invention relates to a liquid ejection head that ejects a liquid, an ejection method that a liquid is ejected from the liquid ejection head, and a printing apparatus that employs the liquid ejection head to eject a liquid for printing.

2. Description of the Related Art

An ink ejection system that employs heating resistor elements has been commonly employed as a liquid ejection method for an ink jet printing apparatus. In this type of ink jet printing apparatus, bubbles are generated on the heating resistor elements, and thereby ink is ejected by a print head to perform printing. When printing is performed by this type of ink jet printing apparatus, cavitation occurs when bubbles generated on the heating resistor elements have become smaller and disappeared. The occurrence of cavitation might adversely affect the service life of the heating resistor elements.

A liquid ejection head is disclosed in Japanese Patent Laid-Open No. 2002-321369, wherein in order to reduce the adverse effect for each heating resistor element due to cavitation, the center of an ink flow path is arranged offset from the center of the heating resistor element in a direction perpendicular to the direction in which ink is to be supplied. Since the liquid ejection head is arranged in this manner, a bubble becomes smaller and disappears at a location apart from the heating resistor element. As a result, the occurrence of cavitation on the heating resistor element can be prevented, and the adverse effect on the service life of the heating resistor element can be reduced.

However, according to the arrangement of the print head disclosed in Japanese Patent Laid-Open No. 2002-321369, it is required that space for bubble generation chambers be prepared to provide a bubble break position offset from the heating resistor element in a direction perpendicular to the direction in which ink is to be supplied. Therefore, the space required for the individual bubble generation chambers is increased, and ejection ports can not be arranged with high density. Accordingly, the size of the liquid ejection head would be increased.

SUMMARY OF THE INVENTION

Therefore, in view of the above-described circumstances, one objective of the present invention is to provide a liquid ejection head, wherein the adverse effect of a heating resistor element due to cavitation is reduced, and also, the space required for bubble generation chambers in a direction perpendicular to the ink supply direction is reduced, and a printing apparatus employing this liquid ejection head.

According to one aspect of the present invention, a liquid ejection head includes a bubble generation chamber in which a liquid is to be retained; a heating resistor element arranged, facing the bubble generation chamber, so as to be able to heat the liquid retained in the bubble generation chamber; an ejection port that is formed open to eject the liquid retained in the bubble generation chamber; an ejection portion along which the liquid flows between the ejection port and the bubble generation chamber; and a liquid supply port employed to supply the liquid to the bubble generation chamber, wherein when the heating resistor element is driven and heats the liquid, a bubble is generated in the liquid retained in the bubble generation chamber, and forces the liquid to be ejected, and thereafter, the bubble becomes smaller and disappears without contacting the atmosphere, wherein when a length of the heating resistor element in a direction in which the liquid is to be supplied is defined by L, the center of the ejection port is shifted, at a distance equal to or longer than L/7, toward a location of the liquid supply port, from the center of a surface of the heating resistor element, viewed in a direction in which the liquid is to be ejected, and wherein when a length of the ejection portion in the direction in which the liquid is to be ejected is defined as l and a length of the bubble generation chamber in the direction in which the liquid is to be ejected is defined as h, l/h is equal to or less than 2.

According to one aspect of the present invention, a printing apparatus includes a liquid ejection head, which includes a bubble generation chamber in which a liquid is to be retained, a heating resistor element arranged, facing the bubble generation chamber, so as to be able to heat the liquid retained in the bubble generation chamber, an ejection port that is formed open to eject the liquid retained in the bubble generation chamber, an ejection portion along which the liquid flows between the ejection port and the bubble generation chamber, and a liquid supply port employed to supply the liquid to the bubble generation chamber, wherein when the heating resistor element is driven and heats the liquid, a bubble is generated in the liquid retained in the bubble generation chamber, and forces the liquid to be ejected, and thereafter, the bubble becomes smaller and disappears without contacting the atmosphere; and a mounting unit on which the liquid ejection head is to be mounted, wherein ejection of the liquid is performed to print a printing medium, wherein when a length of the heating resistor element in a direction in which the liquid is to be supplied is defined by L, the center of the ejection port is shifted, at a distance of equal to or longer than L/7, toward a location of the liquid supply port, from the center of a surface of the heating resistor element, viewed in a direction in which the liquid is to be ejected, and wherein when a length of the ejection portion in the direction in which the liquid is to be ejected is defined as l and a length of the bubble generation chamber in the direction in which the liquid is to be ejected is defined as h, l/h is equal to or less than 2.

According to still another aspect of the present invention, an ejection method for ejecting ink from a liquid ejection head is provided, the liquid ejection head including a bubble generation chamber in which a liquid is to be retained, a heating resistor element arranged, facing the bubble generation chamber, so as to be able to heat the liquid retained in the bubble generation chamber, an ejection port that is formed open to eject the liquid retained in the bubble generation chamber, an ejection portion along which the liquid flows between the ejection port and the bubble generation chamber, and a liquid supply port employed to supply the liquid to the bubble generation chamber, wherein when the heating resistor element is driven and heats the liquid, a bubble is generated in the liquid retained in the bubble generation chamber, and forces the liquid to be ejected, and thereafter, the bubble becomes smaller and disappears without contacting the atmosphere, the ejection method comprising a step of: performing a process in which a bubble after expansion becomes smaller until disappearing, while maintaining a state where a height of a portion of the bubble that is at the rear from the center of the bubble in a direction in which the liquid is to be supplied from the liquid supply port to the bubble generation chamber is always greater than a height of the bubble that is in front of the bubble from the center in the direction.

According to the present invention, since a load imposed on the heating resistor element due to cavitation can be reduced, durability of the liquid ejection head can be improved. Therefore, the cost for operating the liquid ejection head can be reduced. Furthermore, since ejection ports can be closely arranged for the liquid ejection head, printing of high resolution images is enabled, and a compact liquid ejection head can be prepared, and the manufacturing cost for the liquid ejection head can be reduced.

Further features of the present invention will become apparent from the following description of exemplary embodiments (with reference to the attached drawings).

DESCRIPTION OF THE EMBODIMENT

A liquid ejection head according to one embodiment of the present invention and a printing apparatus employing this liquid ejection head will now be described while referring to the accompanying drawings.

First, the arrangement of the liquid ejection head according to the embodiment of the present invention will be described.

Figure 1:
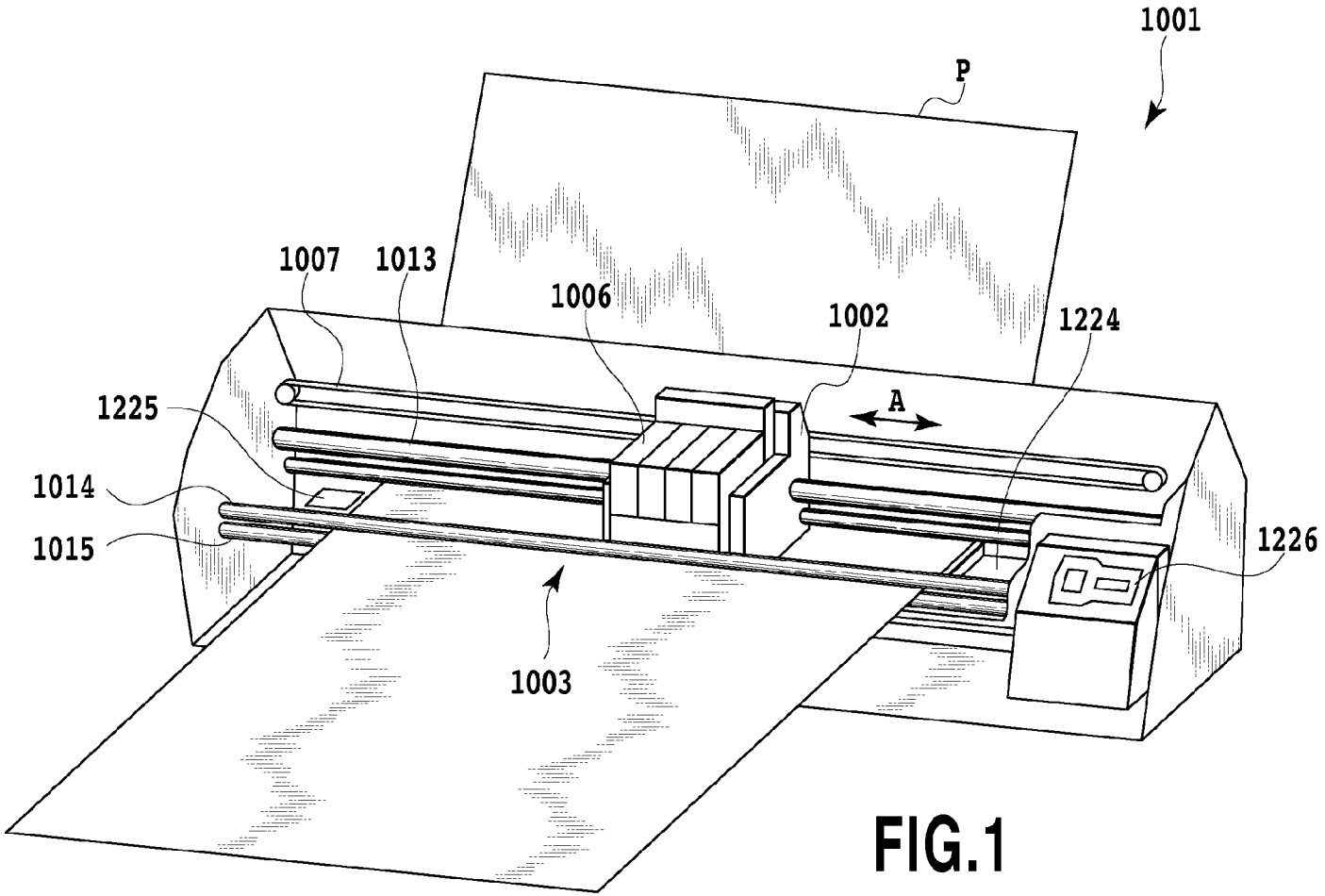
FIG. 1 is a perspective view of an ink jet printing apparatus according to one embodiment of the present invention.

FIG. 1 is a perspective view of an ink jet printing apparatus 1001 according to the embodiment of the invention. A carriage 1002 is provided for the inkjet printing apparatus 1001 that serves as a printing apparatus, and a print head 1003 that serves as a liquid ejection head and an ink cartridge 1006 that stores ink to be supplied to the print head 1003 can be mounted on the carriage 1002. The ink jet printing apparatus 1001 includes the above described carriage (mounting means) 1002 on which the print head 1003 is to be mounted. The ink cartridge 1006 is mountable and detachable to the carriage 1002. Note that, the print head 1003 and the ink cartridge 1006 may be integrally formed.

The ink jet printing apparatus 1001 can perform color printing, and four ink cartridges 1006, where magenta (M), cyan (C), yellow (Y) and black (K) inks are stored, respectively, are mounted to the carriage 1002. These four ink cartridges 1006 can be independently mounted to, or removed from the carriage 1002.

Electrical connection is established between the carriage 1002 and the print head 1003 when the electrical contact portions of these two components appropriately contact each other. When energy is applied in accordance with a print signal, the print head 1003 ejects ink to a printing medium selectively through a plurality of ejection ports, and performs printing. Especially, the print head 1003 in this embodiment employs an ink jet printing system that ejects ink by using thermal energy.

A guide shaft 1013 is arranged in the ink jet printing apparatus 1001 and is extended in the main scan direction of the carriage 1002. The carriage 1002 is supported by the guide shaft 1013 that runs through the carriage 1002. With this structure, the carriage 1002 can slide along the guide shaft 1013 and be guided in a direction indicated by an arrow A.

The carriage 1002 is coupled with one part of a drive belt 1007 that serves as a transmission mechanism for transmitting the drive force of a carriage motor. The carriage 1002 to which the print head 1003 is mounted is reciprocally moved by the drive force of the carriage motor. As a result, when the carriage motor rotates forward or backward, the carriage 1002 is moved reciprocally along the guide shaft 1013 in the main scanning direction that is crossing to a direction in which a printing medium is to be conveyed. Furthermore, the ink jet printing apparatus 1001 includes a scale (not shown) to indicate the position of the carriage 1002 in a direction in which the carriage 1002 moves (the direction indicated by the arrow A). When the print head 1003 ejects ink while moving in the main scanning direction, printing is performed for the entire width of a printing medium P. The ink jet printing apparatus 1001 also includes a platen on the side opposite the ejection port face where the ejection ports of the print head 1003 are formed.

The ink jet printing apparatus 1001 further includes a conveying roller 1014 that is to be driven by a conveying motor (not shown) in order to convey the printing medium P. Moreover, the ink jet printing apparatus 1001 includes a pinch roller 1015 that employs a spring (not shown) to bring the printing medium P in contact with the conveying roller 1014. The ink jet printing apparatus 1001 also includes a pinch roller holder (not shown) that supports the pinch roller 1015 to be rotatable, and a conveying roller gear (also not shown) that is connected to the conveying roller 1014. When rotation of the conveying motor is started, the driven force generated by the rotation of the conveying motor is transmitted via the conveying roller gear to the conveying roller 1014, which is then driven. The above described conveying unit for conveying a printing medium is arranged in the ink jet printing apparatus 1001. When the conveying roller 1014 is rotated in the state wherein the printing medium P is sandwiched between the conveying roller 1014 and the pinch roller 1015, the printing medium P is conveyed in the conveying direction.

Furthermore, the ink jet printing apparatus 1001 includes a cap 1226, with which the ejection ports of the print head 1003 are capped to accept ink ejected by the print head 1003. When preliminary ejection using pigment ink is performed in the state wherein the ejection ports of the print head 1003 are covered with the cap 1226, ink is absorbed inside the cap 1226, and therefore, the ink ejected during the preliminary ejection using pigment ink can be collected. Furthermore, a platen home preliminary ejection position 1224 and a platen away preliminary ejection position 1225, at which ink ejected during preliminary ejection performed over the platen is to be received, are located outside the printing medium P in FIG. 1.

Figure 2:
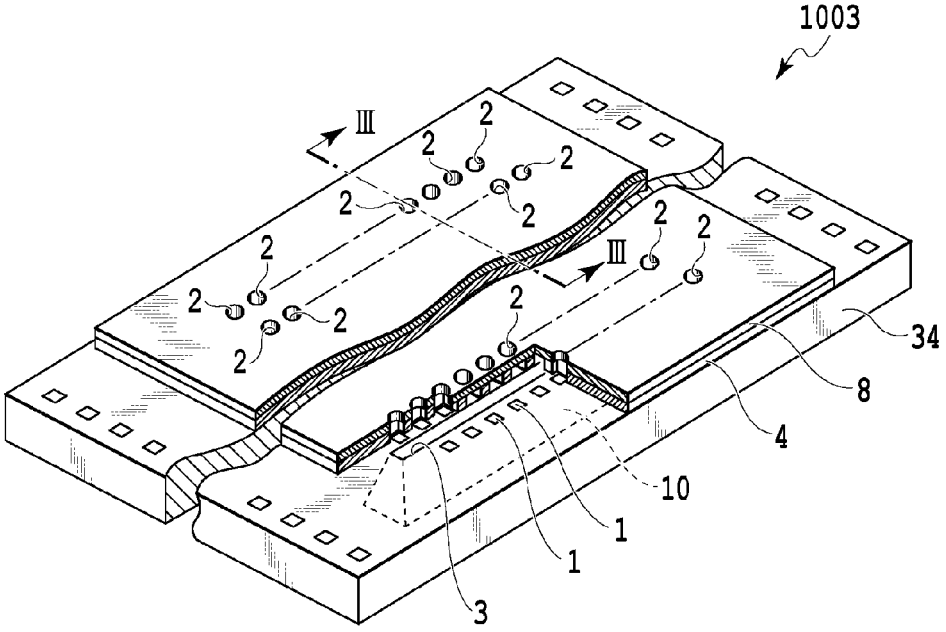
FIG. 2 is a partially exploded perspective view of for explaining the internal structure for a substrate, an ejection port plate and a flow path forming member prepared for a print head employed for the ink jet printing apparatus in FIG. 1.
Figure 3:
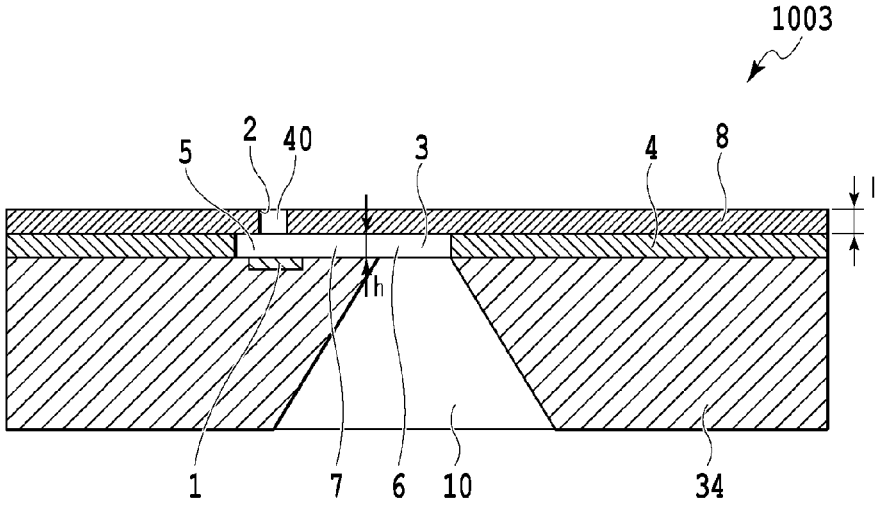
FIG. 3 is a cross-sectional view of the print head in FIG. 2, taken along a line III-III.

FIG. 2 is a perspective view of the print head 1003 of this embodiment. Further, FIG. 3 is a cross-sectional view of the print head 1003 in FIG. 2, taken along a line III-III.

The print head 1003 includes a substrate 34, a flow path forming member 4 and an ejection port plate 8. The flow path forming member 4 and the ejection port plate 8 are mounted to the substrate 34. An ink supply chamber 10 and an ink supply port (a liquid supply port) 3 are formed in the substrate 34. The ink supply chamber 10 communicates with a common liquid chamber 6 and liquid flow paths 7 via the ink supply port 3 that is an opening portion formed in the surface of the substrate 34. Since the flow path forming member 4 and the ejection port plate 8 are arranged in the substrate 34, bubble generation chambers 5 are defined between these components. Ejection ports 2 that serve as external openings are formed in the ejection port plate 8 in order to eject ink stored in the bubble generation chambers 5. Ejection portions 40 are formed inside the ejection port plate 8, and serve as flow paths, along which ink stored in the bubble generation chambers 5 is to be supplied to the ejection ports 2. With the ejection portions 40, supply of ink from the bubble generation chambers 5 to the ejection ports 2 is performed.

As shown in FIG. 2, the narrow, rectangular ink supply port 3 is formed in the face of the substrate 34 where the flow path forming member 4 and the ejection port plate 8 are mounted. The ink supply port 3 is an opening portion shaped like a long groove that is formed in the surface of the substrate 34, and corresponds to the opening extended to the ink supply chamber 10. The ink supply chamber 10 is formed like a groove in the substrate 34, and communicates with the bubble generation chambers 5 and the ejection ports 2 via the ink supply port 3 and the liquid flow paths 7.

Heating resistor elements 1 serving as ejection energy generating elements that effect ejection of ink are arranged in the substrate 34 at locations facing the bubble generation chambers 5. These heating resistor elements 1 are aligned as an array on either longitudinal side of the ink supply port 3 at pitches of 600 dpi. The ejection ports 2 are arranged in the ejection port plate 8 so that the ejection ports 2 correspond to the heating resistor elements 1.

The substrate 34 serves as one part of the flow path forming member 4, and the material employed for the substrate 34 is not particularly limited so long as the substrate 34 can serve as an ejection energy generation member and as a member that supports a material layer that forms the ejection port 2 and flow paths that will be described later. In this embodiment, a silicon substrate is employed as the substrate 34. As shown in FIG. 3, the liquid flow paths 7 are formed between the ink supply port 3 and the individual bubble generation chambers 5, and are employed to guide ink from the ink supply port 3 to the corresponding bubble generation chambers 5. The same material member is employed for the ejection port plate 8 and the flow path forming member 4 in this embodiment; however, different materials may also be employed to obtain the same effects.

Figure 4:
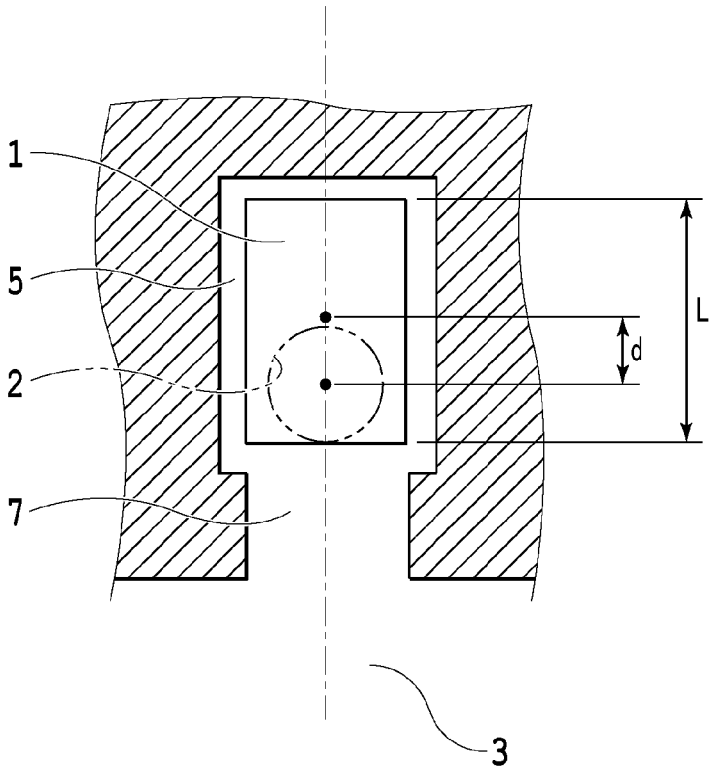
FIG. 4 is a cross-sectional view of the periphery of the ejection port of the print head in FIG. 2.

The shape of the portion around the ejection port 2 formed in the print head 1003 for this embodiment is shown in FIG. 4. FIG. 4 is an enlarged cross-sectional view of the portion of the bubble generation chamber 5 around the ejection port 2. As shown in FIG. 4, the ejection port 2 has a circular shape with a diameter of 10 μm. In this embodiment, the distance at which the center of the ejection port 2 is offset to the center of the heating resistor element 1 is 8 μm. That is, the center of the ejection port 2 is shifted from the center of the heating resistor element 1 toward the ink supply port 3 by a distance of 8 μm. The heating resistor element 1 has a rectangular shape, for which the length in a direction perpendicular to the ink supply direction is 23.2 μm, while the length in the ink supply direction is 38.8 μm, and the aspect ratio is 1.67 (=38.8/23.2). Since the circular ejection ports 2 are employed for this embodiment, the position of the center of the ejection port 2 is at the center of the circle. Furthermore, in this embodiment, the heating resistor element 1 has a rectangle shape having a long side in the direction in which ink is supplied from the ink supply port 3 to the bubble generation chamber 5. Therefore, the intersection point of diagonal lines of the rectangular heating resistor element 1 is employed as the center of the heating resistor element 1.

Furthermore, in this embodiment, referring to FIG. 3, a height h of the flow path forming member 4 is 20 μm, and a thickness l of the ejection port plate 8 is 23 μm. The volume of an ink droplet ejected by the heating resistor element 1 via the ejection port 2 is about 13 ng.

In this invention, when the ejection ports 2 are arranged in the above described manner, the occurrence of cavitation in the upper face of the heating resistor elements 1 and the adverse effect to the heating resistor elements 1 that is accompanied by the occurrence of cavitation are reduced. This principle will now be described.

Figure 5A:
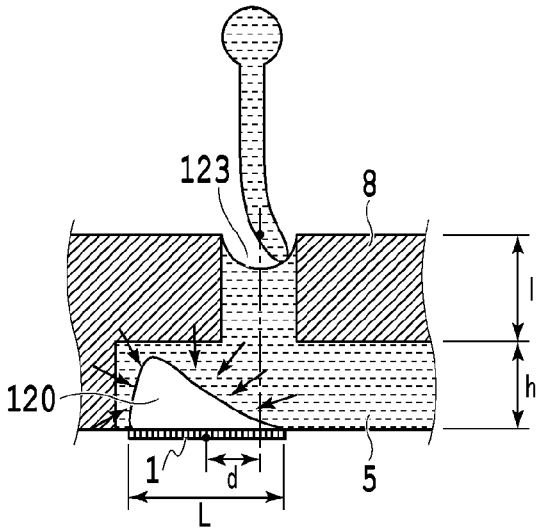
FIGS. 5A to 5C are side cross-sectional views, in time series, of the state of a bubble and meniscus obtained when the print head in FIG. 2 performs ejection of ink.
Figure 5B:
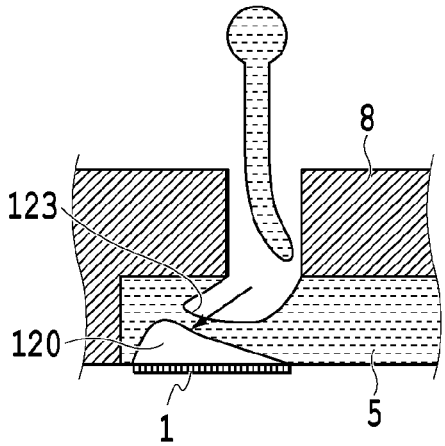
Figure 5C:
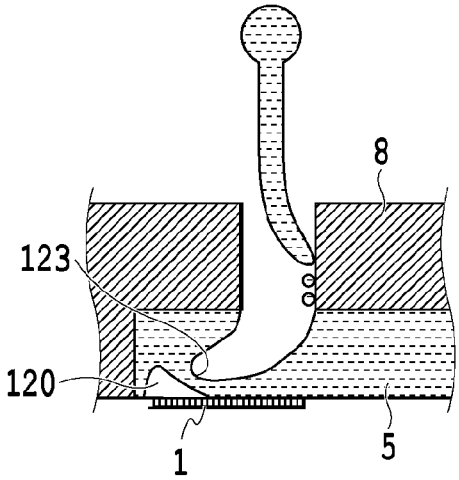
Figure 6A:
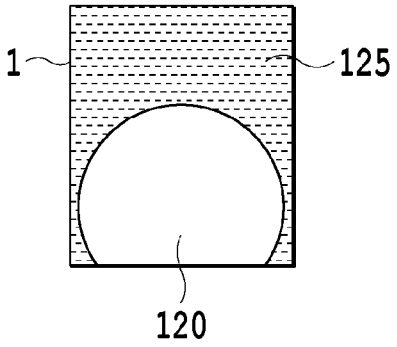
FIGS. 6A to 6C are top cross-sectional views, in time series, of the state of a bubble when the print head in FIG. 2 performs ejection of ink.
Figure 6B:
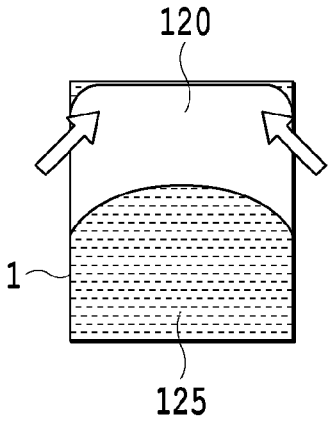
Figure 6C:
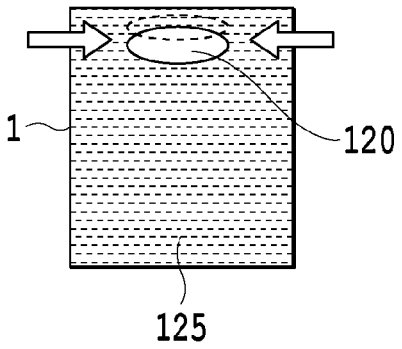

FIGS. 5A to 5C are schematic cross-sectional views for explaining the time-series process in which a bubble becomes smaller before disappearing during ejection of ink performed by the print head 1003 of this embodiment. FIGS. 6A to 6C are schematic top cross-sectional views, taken along the plane immediately above the heating resistor element 1, for explaining the time-series process in which a bubble becomes smaller before disappearing during ejection of ink performed by the print head 1003 of this embodiment.

First, the heating resistor element 1 is driven via wiring and electrodes (neither of them shown) and generates heat. FIG. 6A is a cross-sectional view, taken along the plane immediately above the heating resistor element 1, of the state wherein a bubble is generated on the heating resistor element 1. When the heating resistor element 1 generates heat, ink inside the bubble generation chamber 5 is heated, and film boiling occurs in the ink to form a bubble 120. When the bubble 120 generated by the heat grows, the bubble generation pressure is exerted to eject one part of ink stored in the bubble generation chamber 5 through the ejection port 2. When the volume of the bubble 120 is increased and has reached the maximum level, as shown in FIG. 5A, the bubble 120 then becomes smaller, and meniscus 123 of ink positioned inside the ejection portion 40 that communicates with the ejection port 2 is displaced downward towards the bubble generation chamber 5.

When ejection of ink is performed, the volume of ink equivalent to the amount of ejected ink is supplied to the bubble generation chamber 5 from the ink supply port 3 via the liquid flow path 7 to refill the bubble generation chamber 5. The time-series process in which the meniscus is displaced downward until the bubble 120 disappears is shown in FIGS. 5A and 5B. In this embodiment, since the ejection port 2 is formed, so that the center of the ejection port 2 is greatly shifted from the center of the heating resistor element 1 toward the ink supply port 3, ink 125 is supplied beginning with the side close to the ink supply port 3.

When ejection of ink is performed, ink inside the bubble generation chamber 5 is discharged outside, and therefore, a negative pressure is generated inside the bubble generation chamber 5. When the negative pressure is generated inside the bubble generation chamber 5, the meniscus 123 located at the ejection port 2 is moved downward along the ejection portion 40. Further, at this time, ink is supplied to refill the bubble generation chamber 5. Since supply of ink is performed from the ink supply port 3 to the bubble generation chamber 5 in order to refill the bubble generation chamber 5, the amount of ink supplied for refilling differs between the area of the bubble generation chamber 5 close to the ink supply port 3 and the opposite area close to the wall. Since supply of ink is quickly started for the area of the bubble generation chamber 5 close to the ink supply port 3, refilling of the area is quickly completed, and after the area has been refilled, a negative pressure is comparatively seldom generated.

However, a comparatively long period of time is required until the rear area of the bubble generation chamber 5 opposite the side close to the ink supply port 3 is refilled with ink. Since by the time refilling is completed, the speed for supplying of ink differs between the portion of the bubble generation chamber 5 close to the ink supply port 3 and the opposite portion close to the wall, there is a difference in the level of negative pressure generated in the bubble generation chamber 5. During a period from ejection of ink until resupply of ink to the bubble generation chamber 5, the negative pressure is comparatively low in the area of the bubble generation chamber 5 close to the ink supply port 3, and is comparatively high in the opposite portion close to the wall.

As described above, the level of negative pressure differs between the portion of the bubble generation chamber 5 close to the ink supply port 3 and the opposite portion close to the wall. Therefore, the bubble 120 is pulled by the comparatively high negative pressure in the rear portion, and is therefore changed to an asymmetrical shape such that the portion opposite the ink supply port 3 and close to the wall is comparatively thick and the portion close to the ink supply port 3 is thin. Further, the meniscus 123 that is displaced downward from the ejection portion 40 is bent toward the rear of the bubble generation chamber 5, and changes the shape asymmetrically in the direction opposite the ink supply port 3.

FIG. 5B is a cross-sectional view of the periphery of the ejection port 2 in the state wherein the meniscus 123 has moved down along the ejection portion 40 and reached inside the bubble generation chamber 5. Furthermore, FIG. 6B is a cross-sectional view of the pertinent state taken along the plane immediately above the heating resistor element 1. As shown in FIGS. 5B and 6B, during a period since ejection of ink started until the bubble generation chamber 5 is refilled with ink, the meniscus 123 moving downward from the ejection port 40 is pulled by the negative pressure generated at the rear portion of the bubble generation chamber 5, and is changed in shape asymmetrically in the direction toward the rear. Further, the bubble 120 is also pulled by the negative pressure generated at the rear portion of the bubble generation chamber 5, and is changed in shape asymmetrically in the direction toward the rear. Together with the meniscus 123 moving downward from the ejection portion 40, ink present between the ejection portion 40 and the bubble 120 is pulled by the negative pressure. As described above, since the negative pressure at the rear portion of the bubble generation chamber 5 is higher than the negative pressure of the ink supply side of the bubble generation chamber 5, the meniscus 123 that has moved down and reached inside the bubble generation chamber 5 is displaced downward by being greatly bent toward the rear.

Next, the state of the bubble 120 immediately before disappearing and the state of the meniscus 123 are shown in FIG. 5C, and the cross-section taken along the plane immediately above the heating resistor element 1 at this time is shown in FIG. 6C. In this embodiment, the center of the ejection port 2 is located close to the ink supply port 3 by being shifted from the center of the heating resistor element 1. Since the bubble 120 asymmetrically becomes smaller while greatly deviated to the rear of the bubble generation chamber 5, disappearing of the last portion of the bubble 120 occurs in a comparatively wide area at the rear of the bubble generation chamber 5 as shown in FIG. 6C. Further, each time ejection of ink is performed, the meniscus 123 moves down to the area where the bubble 120 has disappeared. In the FIG. 6C, a portion where the disappearance of bubble is occurred is indicated by white portion and dotted line. In the process in which the bubble 120 becomes smaller and disappears, the bubble 120 does not contact the atmosphere and bubble is disappeared in the bubble generation chamber 5.

Since a comparatively high negative pressure is exerted from the rear of the bubble generation chamber 5 due to reduction of the size of the bubble 120 during ejection of ink, the meniscus 123 receives a force in a direction from the ink supply port 3 to the rear wall, and approaches the heating resistor element 1 by being shifted to the rear. At this time, the positional deviation distance between the ejection port 2 and the heating resistor element 1 and the displacement of the meniscus 123 caused by the flow of ink are counterbalanced each other, the meniscus 123 that moves down from the ejection port 2 approaches the location near the center of the bubble 120. Therefore, the bubble 120 is pushed by the meniscus 123 that moves down from the ejection port 2, in a direction from the ink supply port 3 to the rear of the bubble generation chamber 5, and becomes smaller.

In this embodiment, since the meniscus 123 that moves down from the ejection port 2 is positioned close to the bubble 120 at a location near the center of the bubble 120, it is rare that the bubble 120 will be broken apart by the meniscus 123.

After ejection of ink has been performed, the negative pressure generated in the bubble generation chamber 5 is applied to the meniscus 123, which therefore is forced to be pushed through the ejection portion 40 of the ejection port plate 8, and is moved toward the heating resistor element 1, so that the meniscus 123 is displaced below the ejection port plate 8 and approaches the heating resistor element 1. Therefore, the distance at which the meniscus 123 moves from the ejection portion 40 of the ejection port plate 8 to the heating resistor element 1 is not constant, and may vary depending on the performance of ink ejection.

Further, the level of the negative pressure generated in the bubble generation chamber 5 during ejection of ink is not always constant. Therefore, the degree at which the meniscus 123 is pulled to the rear of the bubble generation chamber 5 may be varied for each performance of ink ejection. That is, the degree at which the meniscus 123 is deviated in the direction of the rear of the bubble generation chamber 5 may not be constant depending on the performance of ejection of ink. Therefore, the degree at which the bubble 120 is pushed by the meniscus 123 may also be changed for each performance of ink ejection.

For this reason, in the processing in which the heating resistor element 1 is driven and generates a bubble for ejection of ink, and the generated bubble thereafter disappears, the location where the bubble becomes smaller and disappears is not constant. In this embodiment, since the ejection port 2 is located by being shifted from the heating resistor element 1 toward the ink supply port 3, the location of the meniscus 123 is shifted toward the ink supply port 3, and appropriate space is obtained when the bubble disappearing location is variously distributed.

In this case, disappearing of the bubble 120 occurs at a location indicated by a white region as shown in FIG. 6C, and disappearing of a bubble may also occur at a location indicated by a dotted line. As described above, when ejection of ink is performed by employing the print head 1003 of this embodiment, disappearing of the bubble 120 occurs at different locations within a specific range. Since the location at which the bubble 120 becomes smaller and disappears is varied, continuous imposing of the impact only on one location during disappearing of the bubble can be prevented. Therefore, the load imposed on the heating resistor element 1 can be reduced, and the adverse effect due to the cavitation can be decreased.

When various bubble disappearing locations are to be provided for the bubble 120 that is generated in the bubble generation chamber 5, a positional deviation distance d between the center of the heating resistor element 1 and the center of the ejection port 2 and the ratio of a height h of the flow path forming member 4 relative to a thickness l of the ejection port plate 8 are important parameters. The present inventor conducted experiments to examine how the positional deviation d and the ratio of the height h of the flow path forming member 4 to the thickness l of the ejection port plate 8 affected the distribution of the bubble disappearing locations.

Figure 7A:
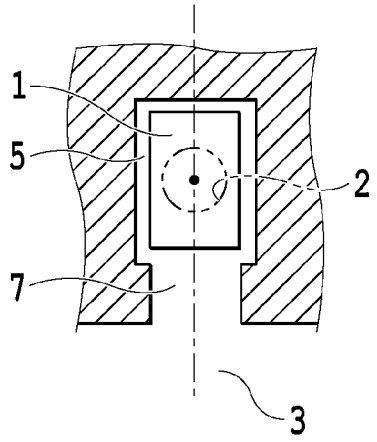
FIGS. 7A to 7C are cross-sectional views of comparison examples, each indicating the positional relationship between an ejection port and a heating resistor element.
Figure 7B:
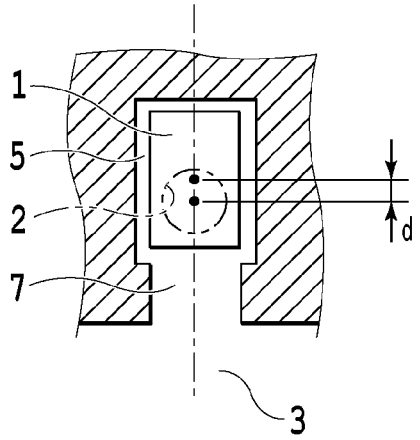
Figure 7C:
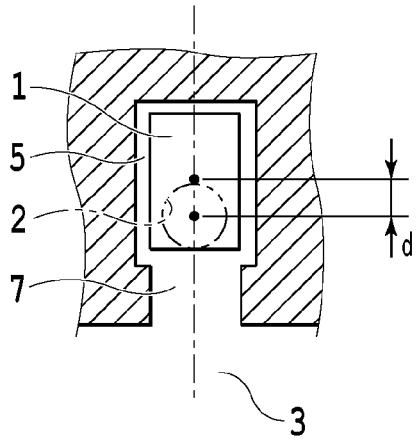

The experiment conducted will now be described while referring to FIGS. 7 to 13. FIGS. 7A to 7C are schematic cross-sectional views of the liquid flow paths 7 of the print heads employed for the individual comparison examples. In FIGS. 7A to 7C, the deviation distance d between the center of an ejection port 2 and the center of a heating resistor element 1 and the ratio of the height h of the flow path forming member 4 to the thickness l of the ejection port plate 8 is changed.

As shown in FIGS. 7A to 7C, the deviation distances d for the individual print heads fall within a range of 0 μm to −8 μm. In this case, in the range where the deviation distance d is a negative value (FIG. 6B or FIG. 6C), the center of the ejection port 2 is shifted from the center of the heating resistor element 1 to the ink supply port 3 side. The present inventor examined the degree of cavitation that occurred in the flow paths 7 and the presence or the absence of damage on the heating resistor elements 1 during the ejection durability test when ejection of ink by employing the print heads having the arrangements shown in FIGS. 7A to 7C is performed. The results obtained through the test are shown in Table 1. In Table 1, the degree at which the occurrence of cavitation is prevented and the durability of the heating resistor element 1 (the degree of prevention of damage) are represented by three stages, ○, Δ and x. According to the test results, ○ represents good (satisfactory degree of allowance), Δ represents minor cavitation occurred, and x represents that the heating resistor element 1 was damaged because of disappearing of bubbles concentrated on one location.

TABLE 1

| | Degree of Cavitation | | |
|---|---|---|---|
| Positional Deviation Distance d (μm) | 0 | −4 | −8 |
| 1/h ≤ 2 | x | Δ | ○ |
| 2 < 1/h | — | — | x |

Referring to Table 1, it is apparent that in the case of l/h≤2, when the absolute value of the deviation of the center of the ejection port 2 relative to the center of the heating resistor element 1 is increased, the degree of distribution of the cavitation in the heating resistor element 1 is improved, and the durability of the heating resistor element 1 is increased. That is, in a case wherein l/h is 2 or smaller, the deviation distance d between the center of the ejection port 2 and the center of the heating resistor element 1 can be increased to reduce the load imposed on the heating resistor element 1 due to the cavitation that occurs due to disappearing of the bubble.

Figure 8A:
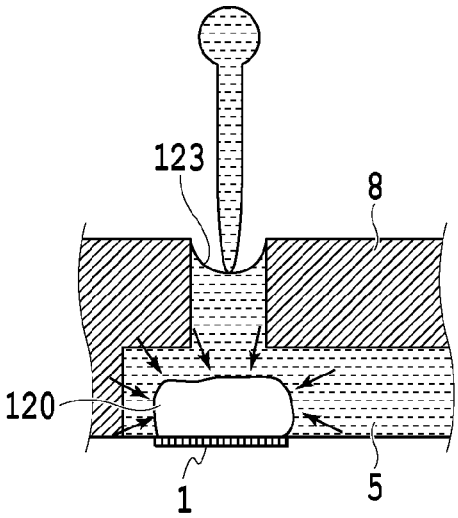
FIGS. 8A to 8C are side cross-sectional views, in time series, of the state of a bubble and meniscus obtained when ejection of ink is performed in one comparison example.
Figure 8B:
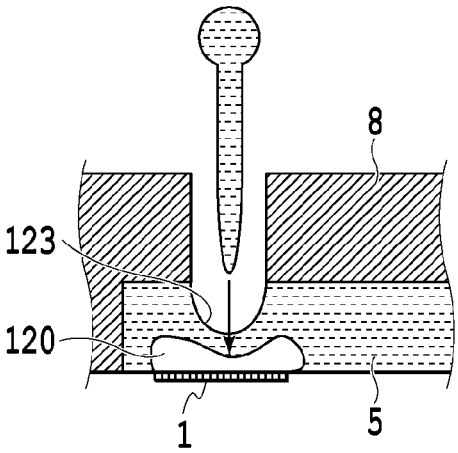
Figure 8C:
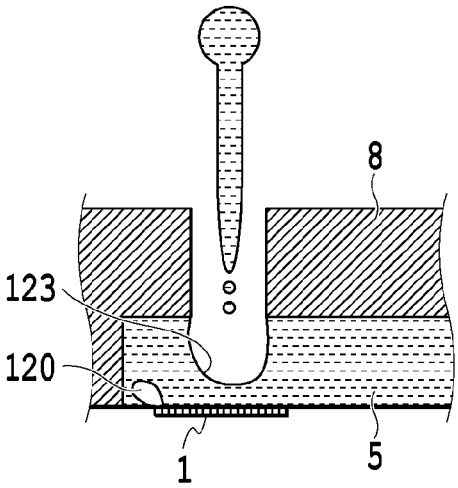
Figure 9A:
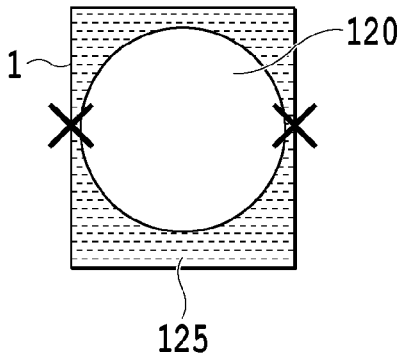
FIGS. 9A to 9C are top cross-sectional views, in time series, of the state of a bubble when ejection of ink is performed in the comparison example.
Figure 9B:
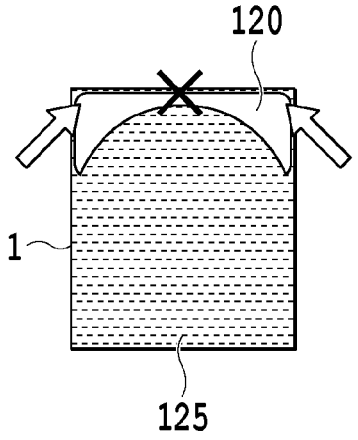
Figure 9C:
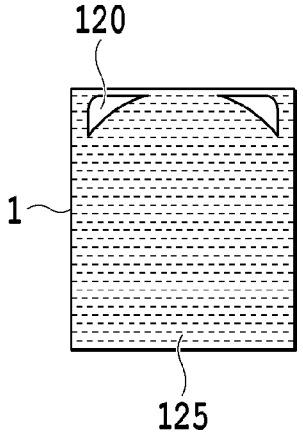

FIGS. 8A to 8C are schematic cross-sectional views for explaining a time-series process in which a bubble becomes smaller until disappearing for the liquid ejection head in a case wherein, as shown in FIG. 7A, the deviation distance between the center of the ejection port 2 and the center of the heating resistor element 1 is 0 μm. Further, FIGS. 9A to 9C are schematic top cross-sectional views, taken along the plane immediately above the heating resistor element 1, of the bubble disappearing process for the print head by employing a liquid ejection method in a case wherein the deviation distance is 0 μm. In the process in which the bubble 120 generated by driving the heating resistor element 1 as shown in FIG. 9A becomes smaller as shown in FIG. 8A, ink near the center of the ink flow path is less affected by the flow frictional resistance than the ink near the wall of the flow path, and is therefore easily moved. Thus, when the bubble 120 becomes smaller to disappear, the ink located near the center line of the flow path flows toward the bubble generation chamber 5 in a very short period of time, and the bubble 120 is changed into a recessed shape.

The state wherein the meniscus 123 has been displaced down to the bubble generation chamber 5 is shown in FIG. 8B. When the meniscus 123 is displaced from the ejection portion 40 to the bubble generation chamber 5, the meniscus 123 is moved down toward the location near the center of the bubble 120. The state in FIG. 9B indicates the process in which the bubble 120 breaks apart. At this time, the bubble 120 tends to break apart while a narrow portion indicated by X near the flow path wall is employed as a base point.

Following this, the state of the bubble 120 immediately before disappearing and the state of the meniscus 123 are shown in FIG. 8C. In order to explain for the state of the bubble 120 above the heating resistor element 1 at this time, the cross section taken along the plane immediately above the heating resistor element 1 is shown in FIG. 9C.

For the liquid ejection head where there is no positional deviation between the center of the ejection port 2 and the center of the heating resistor element 1, it is difficult that ink used for refilling flows to the rear, and the deviation of the shape of the meniscus 123 due to the flow of refiling ink is comparatively small. Therefore, in a case wherein there is no positional deviation between the center of the ejection port 2 and the center of the heating resistor element 1, when the meniscus 123 is moved down from the ejection port plate 8 to the heating resistor element 1 after ink has been discharged, it is seldom that the shape of the meniscus 123 is changed to be deviated in the direction to the rear.

The bubble 120 broken apart in the rear area of the bubble generation chamber 5 rarely receives the affect from the meniscus 123, and therefore, becomes smaller and disappears at the constant position. Thus, the occurrence of cavitation concentrates on the same location of the heating resistor element 1, and this might adversely affect the durability of the heating resistor element 1.

Figure 10A:
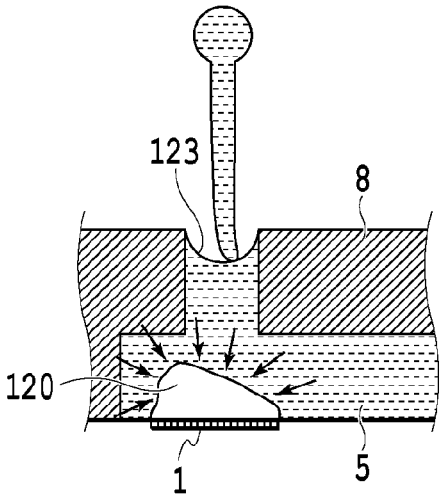
FIGS. 10A to 10C are side cross-sectional views, in time series, of the state of a bubble and meniscus obtained when ejection of ink is performed in another comparison example.
Figure 10B:
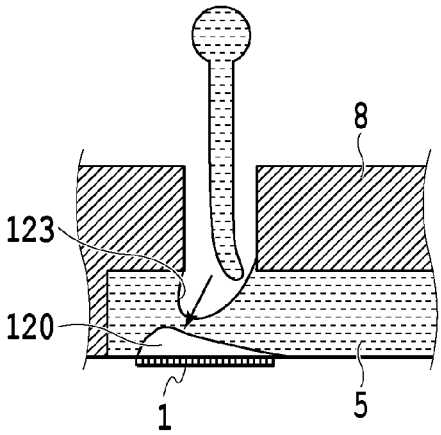
Figure 10C:
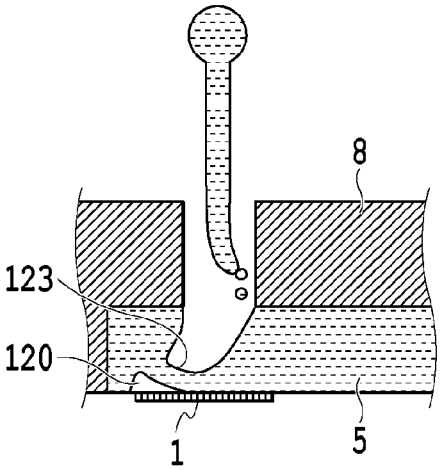
Figure 11A:
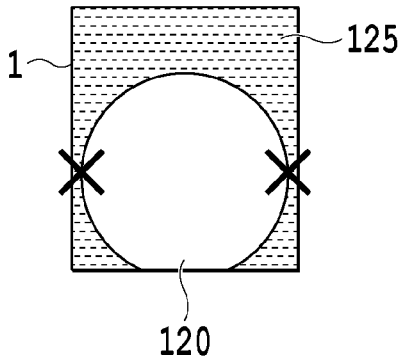
FIGS. 11A to 11C are top cross-sectional views, in time series, of the state of a bubble when ejection of ink is performed in the another comparison example.
Figure 11B:
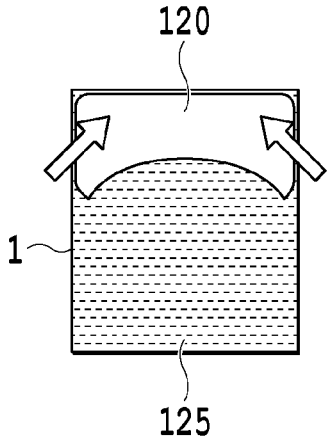
Figure 11C:
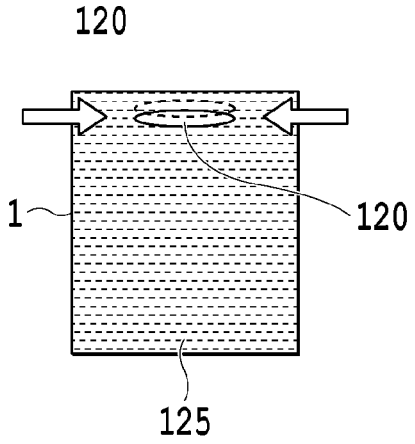

Next, an explanation will be given for the process until a bubble disappears for the liquid ejection head in a case, shown in FIG. 7B, wherein the center of the ejection port 2 is shifted by a distance of −4 μm from the center of the heating resistor element 1. FIGS. 10A to 10C are schematic cross-sectional views for explaining a time-series process until disappearing of a bubble for the print head in a case wherein a positional deviation is −4 μm. FIGS. 11A to 11C are schematic top cross-sectional views, taken along the plane immediately above the heating resistor element 1, of the process until disappearing of a bubble for the print head in a case wherein the positional deviation is −4 μm.

In this case, the ejection port 2 is shifted by a distance of 4 μm from the heating resistor element 1 toward the ink supply port 3 side. Therefore, ink present close to the wall, opposite the ink supply port 3, is more rapidly consumed for ink ejection. Therefore, the negative pressure is generated at the location in the bubble generation chamber 5, close to the wall opposite the ink supply port 3, and the meniscus 123 is bent in a direction opposite the ink supply port 3. The bubble 120 is pushed by the meniscus 123 that is moved by being deviated in a direction opposite the ink supply port 3 in this manner, and is formed in a shape that the portion close to the rear of the bubble generation chamber 5 is raised.

When the heating resistor element 1 is driven, the bubble 120 is generated as shown in FIG. 11A. Thereafter, the bubble 120 becomes smaller, and the meniscus 123 also moves down from the ejection port plate 8. The internal state of the bubble generation chamber 5 wherein the meniscus 123 has been moved down to the bubble generation chamber 5 is shown in FIGS. 10A and 10B. When the meniscus 123 has been moved down to the inside of the bubble generation chamber 5, the meniscus 123 is moved toward the raised portion, of the recessed shape of the bubble 120, where the negative pressure is high. The state in FIG. 11B shows the time-series process in which the bubble becomes smaller until disappearing during the process in which the meniscus 123 is moved from the ejection port plate 8. Since the ejection port 2 is arranged by being shifted to the ink supply port 3, ink 125 is supplied beginning with the portion of the heating resistor element 1 close to the common liquid chamber 6. The bubble 120 tends to be broken apart by employing, as a base point, a narrow portion indicated by x near the flow path wall.

The state of the bubble 120 immediately before disappearing and the state of the meniscus 123 are shown in FIG. 10C, and the state of the bubble 120 above the heating resistor element 1 is shown in FIG. 11, viewed from the top of the ejection port 2. The bubble 120 becomes smaller and disappears, while maintaining the shape deviated to the rear of the bubble generation chamber 5. Further, the meniscus 123 is bent and moved down toward the main portion of the bubble 120. However, since the positional deviation for the liquid ejection head is −4 μm, the degree of the deviation of the shape of the meniscus 123 toward the rear of the bubble generation chamber 5 is smaller than for the case of the liquid ejection head where the positional deviation is −8 μm.

The meniscus 123 at this time is compared with the state in FIG. 5C for a case wherein the positional deviation of the ejection port 2 relative to the heating resistor element 1 is −8 μm, and the amount of deviation to the side opposite the ink supply port 3 is comparatively small. Therefore, the degree at which the bubble 120 is pushed by the meniscus 123 in a direction opposite the ink supply port 3 is small, and the amount of movement of the bubble 120 that is pushed by the meniscus 123 and is moved to the side opposite the ink supply port 3 is comparatively small. Therefore, the bubble 120 disappears at various locations, so that disappearing of the bubble 120 can occur also at the location indicated by the dotted line; however, the degree of distribution for the occurrence of disappearing is comparatively smaller than the case wherein the positional deviation is −8 μm. In a case of the above described liquid ejection head wherein the positional deviation is −4 μm, the degree of interference of the bubble 120 with the meniscus 123 is small, and therefore, the range of the distribution is smaller than the range shown in FIG. 6C. Therefore, since the degree of distribution for the locations where the bubble finally disappears is small, the degree where disappearing of the bubble concentrates on one location in the heating resistor element 1 is increased, and small damage occurs on the heating resistor element 1 due to cavitation.

Following this, a liquid ejection head for a case wherein a thick ejection port plate 8 is employed will now be described. All of the results obtained by the previous discussion are applied for the case of $l/h \leq 2$ where l denotes the thickness of the ejection port plate 8 and h denotes the length (height) for the liquid flow path 7 and the bubble generation chamber 5 in the ink ejection direction. Referring to the results for $l/h \leq 2$ in Table 1, the durability is improved when the positional deviation of the ejection port 2 from the center of the heating resistor element 1 is increased. However, the tendency differs for the case of $l/h > 2$. The tendency for this case will be described below.

Figure 12A:
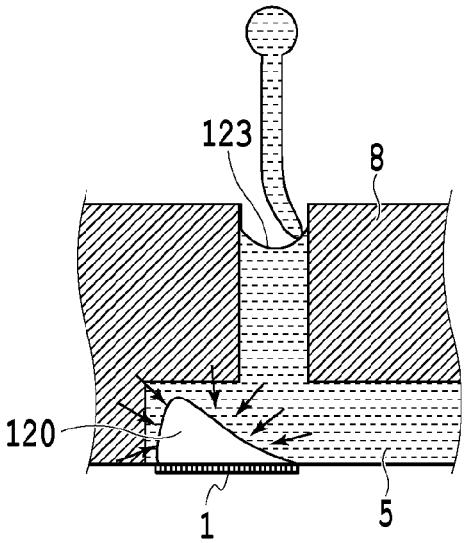
FIGS. 12A to 12C are side cross-sectional views, in time series, of the state of a bubble and meniscus when ejection of ink is performed in a further comparison example.
Figure 12B:
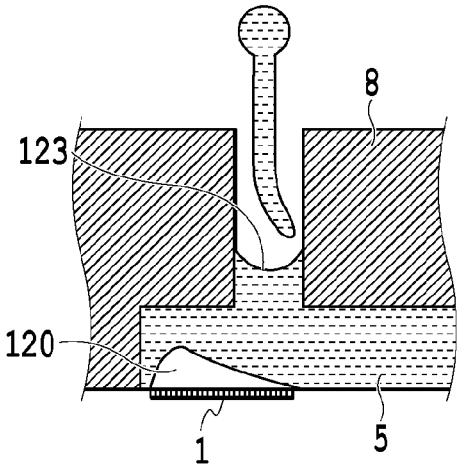
Figure 12C:
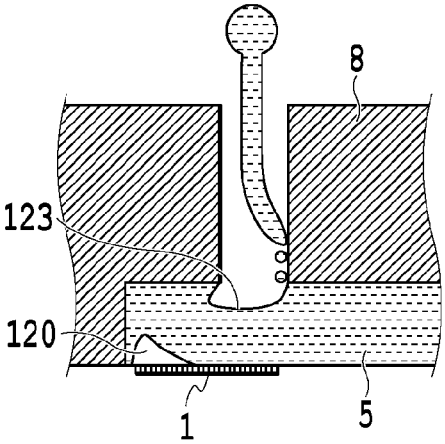
Figure 13A:
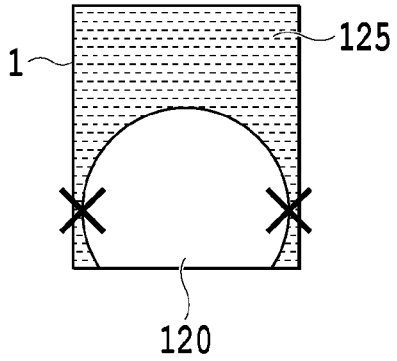
FIGS. 13A to 13C are top cross-sectional views, in time series, of the state of a bubble when ejection of ink is performed in the further comparison example.

FIGS. 12A to 12C are cross-sectional views of a time-series process until disappearing of a bubble for the liquid ejection head in a case shown in FIG. 7C, wherein the positional deviation between the center of the ejection port 2 and the heating resistor element 1 is −8 μm, and $l/h > 2$ is established. Furthermore, FIGS. 13A to 13C are schematic top cross-sectional views, taken along the plane immediately above the heating resistor element 1, of the process until disappearing of a bubble for the liquid ejection head in this case.

For the liquid ejection head in this case, the center of the ejection port 2 is arranged by being shifted by a distance of 8 μm toward the ink supply port 3, as shown in FIG. 7C. Therefore, ink present close to the wall opposite the ink supply port 3 is more rapidly consumed for ink ejection. Therefore, as shown in FIG. 12A, in the process in which the bubble 120 becomes smaller, the shape of the bubble 120 is changed so that the portion of the bubble 120 toward the rear of the bubble generation chamber 5 is raised.

The state wherein the meniscus 123 is displaced further down is shown in FIG. 12B. In a case wherein a relationship of the thickness of the ejection portion 40 and the height for the liquid flow path 7 and the bubble generation chamber 5 is $l/h > 2$, the thickness l of the ejection port plate 8 is large, so that only at a small distance, the meniscus 123 is projected to the inside of the bubble generation chamber 5.

Figure 13B:
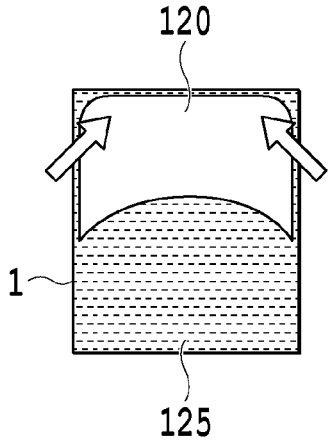
Figure 13C:
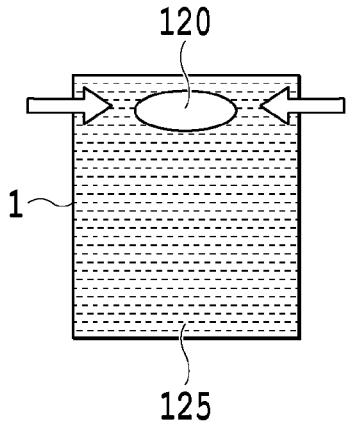

The time-series process until the bubble 120 disappears during the process in which the meniscus 123 is moved down is shown in FIG. 13B. As shown in FIG. 13A, when the bubble 120 is generated by driving the heating resistor element 1, ink is ejected from the ejection port 2, and thereafter, the bubble generation chamber 5 is refilled with ink. The bubble 120 tends to be broken apart by employing, as a base point, a narrow portion indicated by x near the flow path wall.

The state of the bubble 120 immediately before disappearing and the state of the meniscus 123 are shown in FIG. 12C, and the state of the bubble 120 on the heating resistor element 1 is shown in FIG. 13C, viewed from the top of the ejection port 2.

For the liquid ejection head in this case, since the center of the ejection port 2 is shifted from the center of the heating resistor element 1 toward the ink supply port 3, the meniscus 123 that has been moved down to the bubble generation chamber 5 is moved by being deviated toward the rear of the bubble generation chamber 5. However, since a great thickness l of the ejection port plate 8 is provided for the liquid ejection head in this case, the meniscus 123 is moved down only to the area near the entrance of the bubble generation chamber 5. Therefore, compared with the state in FIG. 5C representing the liquid ejection head of this embodiment, the shape of the bubble 120 is not very much changed, but the distance at which the meniscus 123 is projected to the inside of the bubble generation chamber 5 is greatly different.

As shown in FIG. 12C, for the print head in a case of l/h>2, since the meniscus 123 does not project much from the ejection portion 40 to the inside of the bubble generation chamber 5, the bubble 120 is not pushed by the meniscus 123, and is not moved greatly to the rear of the bubble generation chamber 5. As described above, for the print head of l/h>2, since the degree of the interference of the bubble 120 with the meniscus 123 is small, the degree of distribution of the final bubble disappearing locations is small. Thus, the bubble disappearing location concentrates on a specific area of the heating resistor element 1, and as the result of repetitive occurrence of cavitation, comparatively great damage occurs.

It is apparent from the obtained results that, in order to reduce the degree at which the location where a bubble becomes smaller and disappears concentrates on one place, the positional deviation d between the center of the heating resistor element 1 and the center of the ejection port 2 and the ratio of the height h of the flow path forming member 4 relative to the thickness l of the ejection port plate 8 are important parameters. Further, it is also apparent from the results that the degree of the interference of the bubble 120 with the meniscus 123 is correlated also with the amount of ink droplets ejected by driving of the heating resistor element 1. When the ejection volume is reduced, the degree at which the meniscus 123 moves down is reduced, and therefore, the degree of the interference of the bubble 120 with the meniscus 123 is reduced even for the same l/h. When the ejection volume is increased, the degree of the interference of the bubble 120 with the meniscus 123 is increased even for the same l/h. The appropriate ejection volume providing the effects of this invention is 6 to 20 ng, more preferably, 10 to 15 ng.

The present inventor continued intensive study about affects of the positional deviation d and the shape of the heating resistor element 1 on the location where cavitation occurs. As a result, it is found that in order to obtain the effects, it is important that the center of the ejection port 2 be located by being shifted from the center of the heating resistor element 1 toward the common liquid chamber 6 at a distance of equal to or greater than 1/7 of a length L of the heating resistor element 1 in the longitudinal direction (a direction in which a liquid is to be supplied). That is, it is important that, for the print head viewed in a direction in which ink is to be ejected, the center of the ejection port 2 should be located apart from the center of the heating resistor element 1 by a distance of equal to or greater than L/7 toward the location of the ink supply port 3. This is because, when the rectangular shape of the heating resistor element 1 is extended, the positional deviation between the center of the ejection port 2 and the center of the heating resistor element 1 should be increased, and otherwise, the bubble 120 with the rear portion being raised is not easily formed during the process in which the bubble becomes smaller until disappearing.

As described above, according to the print head 1003 of this embodiment, the ejection portion 40 of an appropriate length is formed, and the center of the ejection port 2 is shifted from the center of the heating resistor element 1 at an appropriate distance, so that the meniscus 123 can be moved, with deviation, from the ejection port 2 to the bubble generation chamber 5. Thus, the bubble 120 can be moved by the meniscus 123 toward the rear of the bubble generation chamber 5, and the location where the bubble 120 disappears can be varied properly. Since the occurrence of the bubble 120 disappearing does not concentrate only on one place, but is distributed at various locations, the impact due to disappearing of the bubble 120 does not concentrate on one area. As a result, the load imposed on the print head 1003 can be reduced, and the durability of the print head 1003 can be increased. Furthermore, since the service life of the print head 1003 can be extended, the cost for operating the print head 1003 can be reduced. Additionally, since the number of times for replacement of the print head 1003 can be reduced, the running cost for the printing apparatus can also be reduced.

In the present invention, a circular shape is employed for the ejection ports, but another shape may also be employed, and ejection ports in an elliptical shape or ejection ports with protrusions are also available. Furthermore, a symmetrical structure is not always required for the liquid flow paths 7, and an asymmetrical structure or a deviated structure may also provide the same effects as obtained by the present invention. In this case, the center of gravity in the area of the ejection port is employed as the location of the center of the ejection port. Furthermore, in the above described embodiment, a rectangular heating resistor element is employed; however, the present invention is not limited to this shape, and a heating resistor element in another shape may also be employed. In this case, the center of gravity in the surface area of the heating resistor element is employed as the center of the heating resistor element.

The above described printing apparatus is a so-called serial scan type printing apparatus that prints an image by moving the print head in the main scanning direction while conveying a printing medium in the sub-scanning direction. However, the present invention can also be applied for a full-line head printing apparatus that employs a print head that is extended in the widthwise direction of a printing medium.

In the description for the present invention, "printing" is employed not only for a case wherein significant information, such as characters and figures, is formed, but also for a case wherein insignificant information is formed. Further, "printing" also represents a case wherein an image, a design or a pattern is formed on a printing medium, regardless of whether the information is visually presented so as to be recognized by a person, and a case wherein the processing for a printing medium is performed.

Moreover, a "printing apparatus" includes an apparatus having a printing function, such as a printer, a multifunctional printer, a copier or a facsimile machine, and a manufacturing apparatus that employs the inkjet technology to produce goods.

Further, a "printing medium" represents not only paper employed for a general printing apparatus, but also includes a variety of materials, such as cloth, plastic film, metal sheets, glass, ceramics, a wood material and leather, that can accept ink.

Furthermore, the definition of "ink" (may also be called a "liquid") should be widely interpreted in the same manner as the definition of "printing". That is, "ink" represents a liquid that is applied to a printing medium in order to form an image, a design or a pattern, or to process the printing medium, or to perform treating of ink (for example, coagulating or insolubilizing of the coloring material of ink to be applied to a printing medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-156740, filed Jul. 29, 2013, which is hereby incorporated by reference herein in its entirety.

What is claimed is:

1. A liquid ejection head comprising:

a bubble generation chamber in which a liquid is to be retained;

a heating resistor element arranged, facing the bubble generation chamber, so as to be able to heat the liquid retained in the bubble generation chamber;

an ejection port that is formed open to eject the liquid retained in the bubble generation chamber;

an ejection portion along which the liquid flows between the ejection port and the bubble generation chamber; and a liquid supply port employed to supply the liquid to the bubble generation chamber, wherein when the heating resistor element is driven and heats the liquid, a bubble is generated in the liquid retained in the bubble generation chamber, and forces the liquid to be ejected, and thereafter, the bubble becomes smaller and disappears without contacting the atmosphere, wherein when a length of the heating resistor element in a direction in which the liquid is to be supplied is defined by L, the center of the ejection port is shifted, at a distance equal to or longer than L/7, toward a location of the liquid supply port, from the center of a surface of the heating resistor element, viewed in a direction in which the liquid is to be ejected, and wherein when a length of the ejection portion in the direction in which the liquid is to be ejected is defined as l and a length of the bubble generation chamber in the direction in which the liquid is to be ejected is defined as h, l/h is equal to or less than 2.

2. The liquid ejection head according to claim 1, wherein the ejection port is formed in a circular shape, and the center of the ejection port is the center of the circular shape.

3. The liquid ejection head according to claim 1, wherein the heating resistor element is formed in a rectangular shape, and the center of the surface of the heating resistor element is a point of intersection of diagonal lines of the heating resistor element.

4. A printing apparatus comprising:

a liquid ejection head, which includes a bubble generation chamber in which a liquid is to be retained, a heating resistor element arranged, facing the bubble generation chamber, so as to be able to heat the liquid retained in the bubble generation chamber, an ejection port that is formed open to eject the liquid retained in the bubble generation chamber, an ejection portion along which the liquid flows between the ejection port and the bubble generation chamber, and a liquid supply port employed to supply the liquid to the bubble generation chamber; and a mounting unit on which the liquid ejection head is to be mounted, wherein ejection of the liquid is performed to print on a printing medium, wherein when the heating resistor element is driven and heats the liquid, a bubble is generated in the liquid retained in the bubble generation chamber, and forces the liquid to be ejected, and thereafter, the bubble becomes smaller and disappears without contacting the atmosphere, wherein when a length of the heating resistor element in a direction in which the liquid is to be supplied is defined by L, the center of the ejection port is shifted, at a distance equal to or longer than L/7, toward a location of the liquid supply port, from the center of a surface of the heating resistor element, viewed in a direction in which the liquid is to be ejected, and wherein when a length of the ejection portion in the direction in which the liquid is to be ejected is defined as l and a length of the bubble generation chamber in the direction in which the liquid is to be ejected is defined as h, l/h is equal to or less than 2.

* * * * *